US011804673B2

(12) United States Patent
Cheng

(10) Patent No.: US 11,804,673 B2
(45) Date of Patent: Oct. 31, 2023

(54) ELECTRICAL CONNECTOR

(71) Applicant: ATEN INTERNATIONAL CO., LTD., New Taipei (TW)

(72) Inventor: Hsin-Lang Cheng, New Taipei (TW)

(73) Assignee: ATEN INTERNATIONAL CO., LTD., New Taipei (TW)

( * ) Notice: Subject to any disclaimer, the term of this patent is extended or adjusted under 35 U.S.C. 154(b) by 25 days.

(21) Appl. No.: 17/654,065

(22) Filed: Mar. 8, 2022

(65) Prior Publication Data

US 2022/0311185 A1 Sep. 29, 2022

(30) Foreign Application Priority Data

Mar. 24, 2021 (TW) ..... 110110621

(51) Int. Cl.
*H01R 13/633* (2006.01)
*H01R 13/627* (2006.01)

(52) U.S. Cl.
CPC ..... *H01R 13/633* (2013.01); *H01R 13/6272* (2013.01)

(58) Field of Classification Search
CPC ..... H01R 13/633; H01R 13/6272
USPC ..... 439/354
See application file for complete search history.

(56) References Cited

U.S. PATENT DOCUMENTS 7,033,218 B2 * 4/2006 Huang ..... H01R 13/6275 439/353
7,198,522 B1 * 4/2007 Ho ..... H01R 13/65912 439/353
7,485,007 B1 * 2/2009 Nee ..... H01R 35/02 439/11
9,337,587 B2 * 5/2016 Hsu ..... H01R 13/6593
2020/0203889 A1 * 6/2020 Ohfuku ..... H01R 13/6275
2020/0203890 A1 * 6/2020 Ohfuku ..... H01R 13/6275
2020/0278510 A1 * 9/2020 Zhou ..... G02B 6/4261
2020/0287326 A1 * 9/2020 Masuda ..... H01R 13/6275
2020/0335910 A1 * 10/2020 Lin ..... H01R 13/631
2020/0373708 A1 * 11/2020 Metzler ..... H01R 13/6272
2020/0388958 A1 * 12/2020 Ikeya ..... H01R 13/6272
2020/0388959 A1 * 12/2020 Furugoori ..... H01R 13/7032
(Continued)

FOREIGN PATENT DOCUMENTS

CN 101728663 B 7/2012
CN 206379580 U 8/2017
(Continued)

*Primary Examiner* — Alexander Gilman
(74) *Attorney, Agent, or Firm* — CKC & Partners Co., LLC

(57) ABSTRACT

An electrical connector includes a body portion, a connecting wire, an electrically connecting portion, a locking element and a pressing element. The body portion has a first and a second end portion opposite to the first end. The connecting wire is located at the first end portion. The electrically connecting portion is located at the second end portion. The locking element is located in the electrically connecting portion and has an abutting end and a fastening end. The abutting end is located in the body portion, and the fastening end is located outside of the body portion. The pressing element is movably disposed on the body portion. Two ends of the pressing element are a pressing portion and a driving portion, respectively. The pressing portion is adjacently configured to the first end portion. The driving portion is to contact the abutting end.

11 Claims, 9 Drawing Sheets

(56) References Cited

U.S. PATENT DOCUMENTS

| | | | | |
|---|---|---|---|---|
| 2020/0398684 | A1* | 12/2020 | Motomiya | H01R 13/62944 |
| 2020/0403346 | A1* | 12/2020 | Jove Albos | H01R 13/6273 |
| 2020/0412051 | A1* | 12/2020 | Kida | H01R 13/6272 |
| 2020/0412052 | A1* | 12/2020 | Menez | H01R 13/642 |

FOREIGN PATENT DOCUMENTS

| | | | |
|---|---|---|---|
| TW | M325635 | U | 1/2008 |
| TW | M381907 | U | 6/2010 |
| TW | M400675 | U | 3/2011 |

* cited by examiner

ELECTRICAL CONNECTOR

RELATED APPLICATION

This application claims priority to Taiwan Application Serial Number 110110621, filed Mar. 24, 2021, which is herein incorporated by reference in its entirety.

BACKGROUND

Field of Invention

The present disclosure relates to an electrical connector.

Description of Related Art

In general, an electrically connecting portion of an electrical connector used for images may have a positioning element to produce a positioning effect when the electrically connecting portion inserts into an interface of an electronic device. The electrically connecting portion may also have a pressing element used for unlocking. The pressing element is usually disposed at a position close to the electrically connecting portion and is pressed in a vertical direction. When the electrical connector is needed to be detached from the electronic device, users may press down the pressing element to unlock the positioning element, and then the electrically connecting portion may be withdrawn from the interface of the electronic device. However, when there are two electrical connectors arranged in an up-and-down way, it is disadvantageous to operate removing the lower electrical connector. For example, because the upper electrical connector obstructs an operating space for the users to press the pressing element of the lower electrical connector, the users must remove the upper electrical connector before removing the lower electrical connector. In addition, the design of pressing down the pressing element in the vertical direction has a short force arm with respect to the positioning element, so the users need to press the pressing element of the electrical connector with more effort to unlock the positioning element to remove the electrical connector.

SUMMARY

An aspect of the present disclosure is related to an electrical connector.

According to an embodiment of the present disclosure, an electrical connector includes a body portion, a connecting wire, an electrically connecting portion, a locking element and a pressing element. The body portion has a first and a second end portion opposite to the first end. The connecting wire is located at the first end portion. The electrically connecting portion is located at the second end portion. The locking element is located in the electrically connecting portion and has an abutting end and a fastening end. The abutting end is located in the body portion, and the fastening end is located outside of the body portion. The pressing element is movably disposed on the body portion. Two ends of the pressing element are a pressing portion and a driving portion, respectively. The pressing portion is adjacently configured to the first end portion. The driving portion is to contact the abutting end.

In an embodiment of the present disclosure, an angle between the longitudinal direction of the pressing element and the electrically connecting portion is in a range from 0 to 45 degrees.

In an embodiment of the present disclosure, an angle between the longitudinal direction of the pressing element and the electrically connecting portion is in a range from 5 to 30 degrees.

In an embodiment of the present disclosure, the electrical connector of claim 1 further comprises an upper lid covering the body portion, the driving portion of the pressing element and the abutting portion of the locking element. The upper lid further comprises a first interference structure facing to the pressing element, the pressing element further comprises a second interference structure facing to the upper lid, and the second interference structure is configured to abut the first interference structure.

In an embodiment of the present disclosure, the first interference structure is a protruding rib protruding from the upper lid to the pressing element, the second interference structure is a bump protruding from the pressing element to the upper lid, and the bump is configured to abut the protruding rib to provide feedback to the pressing element.

In an embodiment of the present disclosure, the first interference structure is a protruding rib protruding from the upper lid to the pressing element, the second interference structure is a trench facing to the upper lid, and a surface of the trench is configured to abut the protruding rib to provide feedback to the pressing element.

In an embodiment of the present disclosure, the first interference structure is a trench facing to the pressing element, the second interference structure is a bump protruding from the pressing element to the upper lid, and the bump is configured to abut a surface of the trench to provide feedback to the pressing element.

In an embodiment of the present disclosure, the pressing element further comprises a pushback element, and the pushback element is configured to abut an internal sidewall of the upper lid to provide pushback force.

In an embodiment of the present disclosure, the pressing element is aligned with or exceeds the first end portion of the body portion.

In an embodiment of the present disclosure, at least a portion of the pressing portion overlaps the connecting wire in a vertical direction.

In an embodiment of the present disclosure, the driving portion of the pressing element further comprises a concave portion, and a portion of the abutting end is located in the concave portion.

In an embodiment of the present disclosure, the driving portion of the pressing element has an inclined surface, and the inclined surface is configured to suppress the abutting end of the locking element.

In the embodiments of the present disclosure, due to at least a portion of the pressing portion overlaps the connecting wire in the vertical direction, when a plurality of the electrical connectors arranged in an up-and-down way are detached from the interface of the electronic device, it may avoid the interference of the upper electrical connector to the lower electrical connector. That is to say, the users may directly remove the lower electrical connector, having no need to remove the upper electrical connector so as to remove the lower electrical connector. In addition, the design of the electrical connector has a longer force arm, which allows the users to press the pressing portion of the pressing element along the longitudinal direction of the pressing element with less effort, such that the fastening end of the locking element in the electrically connecting portion is declined, and then the electrically connecting portion may be withdrawn from the interface of the electronic device.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
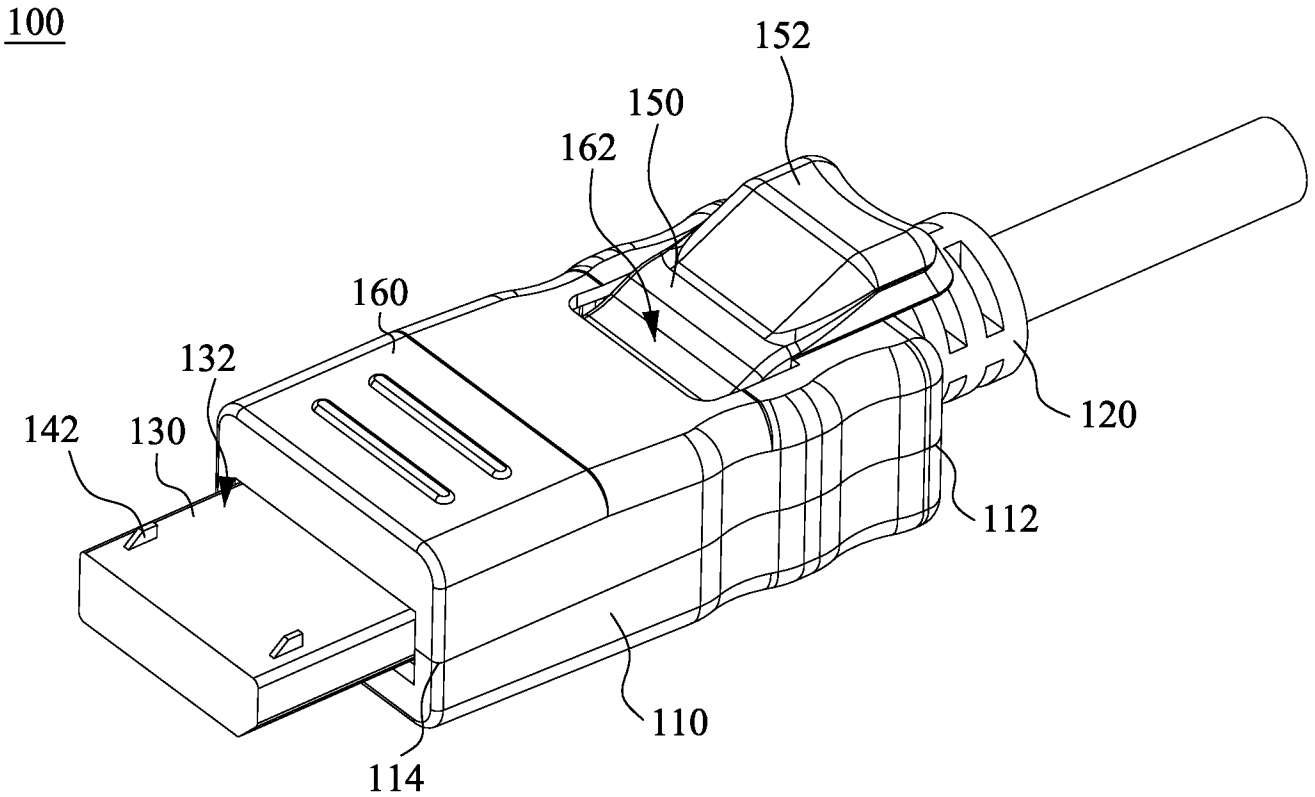
FIG. 1 illustrates a stereoscopic view of an electrical connector according to one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Spatially relative terms, such as "beneath," "below," "lower," "above," "upper," "front," "back" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
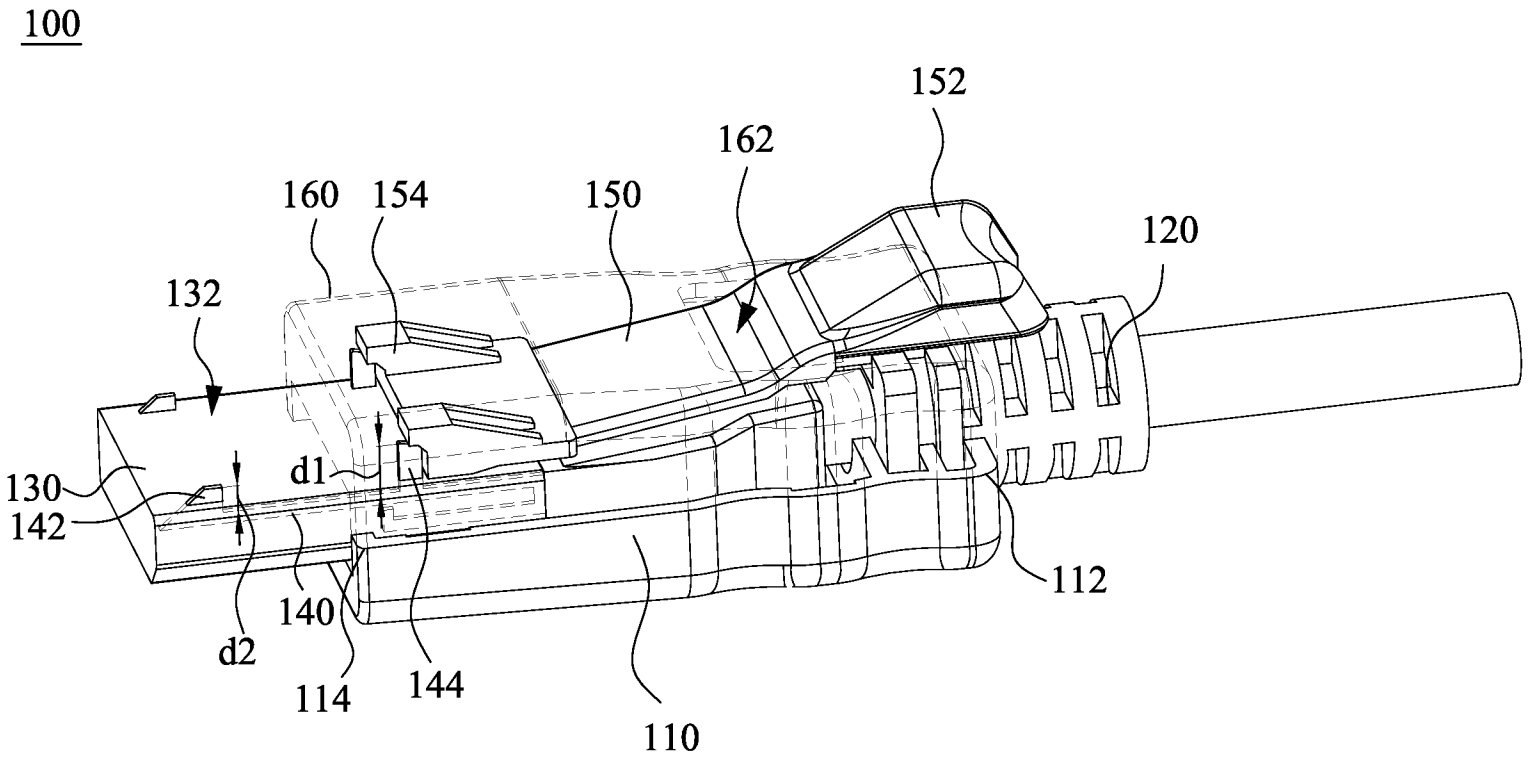
FIG. 2 illustrates a perspective view of the electrical connector in FIG. 1, in which an upper lid is shown by dotted lines.

FIG. 1 illustrates a stereoscopic view of an electrical connector 100 according to one embodiment of the present disclosure. FIG. 2 illustrates a perspective view of the electrical connector 100 in FIG. 1, in which an upper lid 160 is shown by dotted lines. Referring to both FIG. 1 and FIG. 2, the electrical connector 100 includes a body portion 110, a connecting wire 120, an electrically connecting portion 130, a locking element 140 and a pressing element 150. The body portion 110 has a first end portion 112 and a second end portion 114 opposite to the first end portion 112. The connecting wire 120 is disposed at the first end portion 112 of the body portion 110, and the electrically connecting portion 130 is disposed at the second end portion 114 of the body portion 110. The locking element 140 is disposed at the electrically connecting portion 130 and has a fastening end 142 and an abutting end 144. The abutting end 144 is located in the body portion 110, and the fastening end 142 is located outside of the body portion 110. The fastening end 142 and the abutting end 144 of the locking element 140 protrude upward from a top surface 132 of the electrically connecting portion 130. The fastening end 142 may be a positioning element of the electrically connecting portion 130. For example, the fastening end 142 of the locking element 140 may produce a positioning effect when the electrically connecting portion 130 inserts into an interface of an electronic device (will be described in detail in FIG. 5) to stabilize the connection.

In addition, the pressing element 150 is movably disposed on the body portion 110. Two ends of the pressing element 150 are a pressing portion 152 and a driving portion 154, respectively. The pressing portion 152 is disposed adjacently at the first end portion 112 of the body portion 110, and the pressing portion 152 is aligned with or exceeds the first end portion 112 of the body portion 110. At least a portion of the pressing portion 152 overlaps the connecting wire 120 in a vertical direction V (see FIG. 3). In other words, the pressing portion 152 is disposed at a position close to the connecting wire 120, so a portion of the pressing portion 152 may be located above the connecting wire 120, that the users may conveniently press the pressing portion 152 above the connecting wire 120 and along a longitudinal direction L (see FIG. 3) of the pressing element 150. The driving portion 154 of the pressing element 150 is used to contact the abutting end 144 of the locking element 140. When the users press the pressing portion 152 of the pressing element 150 along the longitudinal direction L of the pressing element 150, the driving portion 154 of the pressing element 150 may drive the abutting end 144 of the locking element 140, thereby driving the fastening end 142 from a locking position (for example, the position of the fastening end 142 in FIG. 2) to move to an unlock position (for example, the position of the fastening end 142 in FIG. 3), so that the electrically connection portion 130 is unlocked and may be detached from the interface of the electronic device.

In one embodiment, the electrical connector 100 further includes the upper lid 160. The upper lid 160 of the electrical connector 100 covers the body portion 110, the driving portion 154 of the pressing element 150 and the abutting end 144 of the locking element 140. In addition, the upper lid 160 of the electrical connector 100 further includes an opening 162, and the pressing portion 152 of the pressing element 150 extends outward from the opening 162 of the upper lid 160.

In detail, due to at least a portion of the pressing portion 152 overlaps the connecting wire 120 in the vertical direction V (see FIG. 3), when a plurality of electrical connectors 100 arranged in an up-and-down way are detached from the interface of the electronic device, it may avoid the interference of the upper electrical connector 100 to the lower electrical connector 100. That is to say, the users may directly remove the lower electrical connector 100, having no need to remove the upper electrical connector 100 before removing the lower electrical connector 100. In addition, the design of the electrical connector 100 has a longer force arm (will be described in detail in FIGS. 3 and 4), which allows the users to press the pressing portion 152 of the pressing element 150 along the longitudinal direction L (see FIG. 3) of the pressing element 150 with less effort, such that the fastening end 142 of the locking element 140 in the electrically connecting portion 130 is declined, and then the electrically connecting portion 130 may be withdrawn from the interface of the electronic device.

In some embodiments, the electrical connector 100 may include display port connectors, VGA connectors, USB connectors, and HDMI connectors, but it is not limited in this regard. The pressing element 150 may be made of a material that includes nylon plastic, polybutylene terephthalate (PBT) plastic, polycarbonate (PC) plastic, acrylonitrile butadiene styrene (ABS) plastic, but it is not limited in this regard. The pressing element 150 made of the aforementioned materials has a smooth surface, so that the friction force between the pressing element 150 and the body portion 110 may be reduced. As a result, when the pressing portion 152 is pressed along the longitudinal direction L (see FIG. 3) of the pressing element 150, the loss of the force pressing the pressing portion 152 may be reduced, and the force may be effectively transferred from the driving portion 154 of the pressing element 150 to the abutting end 144 of the locking element 140.

In one embodiment, the locking element 140 is an elastic sheet structure, and the abutting end 144 is closer to the body portion 110 than the fastening end 142. A distance d1 that the abutting end 144 protrudes from the top surface 132 of the electrically connection portion 130 is greater than a distance d2 that the fastening end 142 protrudes from the top surface 132 of the electrically connection portion 130. That is, a vertical height that the abutting end 144 protrudes from the top surface 132 is greater than a vertical height that the fastening end 142 protrudes from the top surface 132, but it is not limited in this regard.

Figure 3:
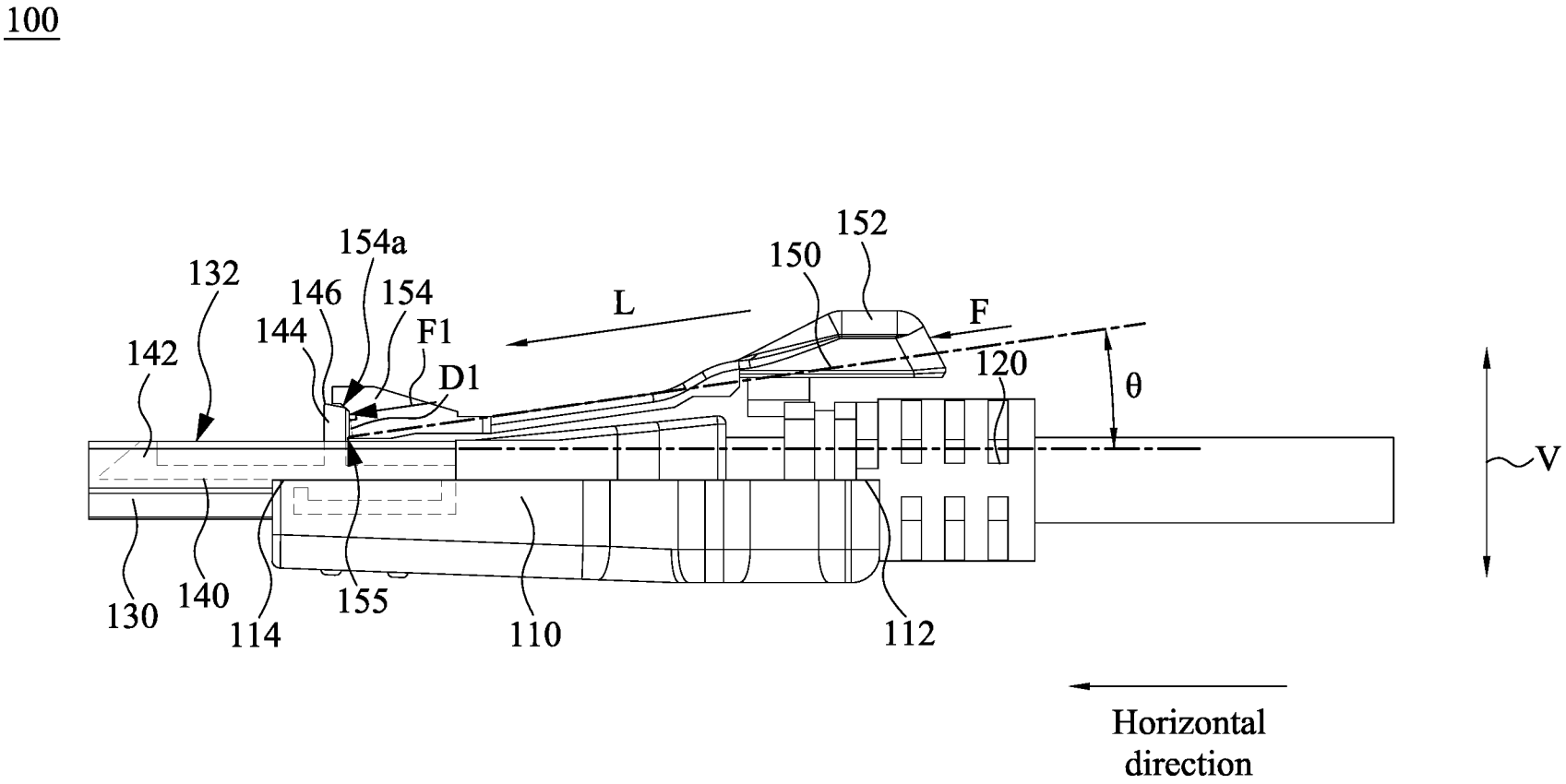
FIG. 3 and FIG. 4 illustrate schematic views when a pressing portion of the electrical connector in FIG. 2 is pressed along a longitudinal direction of a pressing element, in which an upper lid is omitted.
Figure 4:
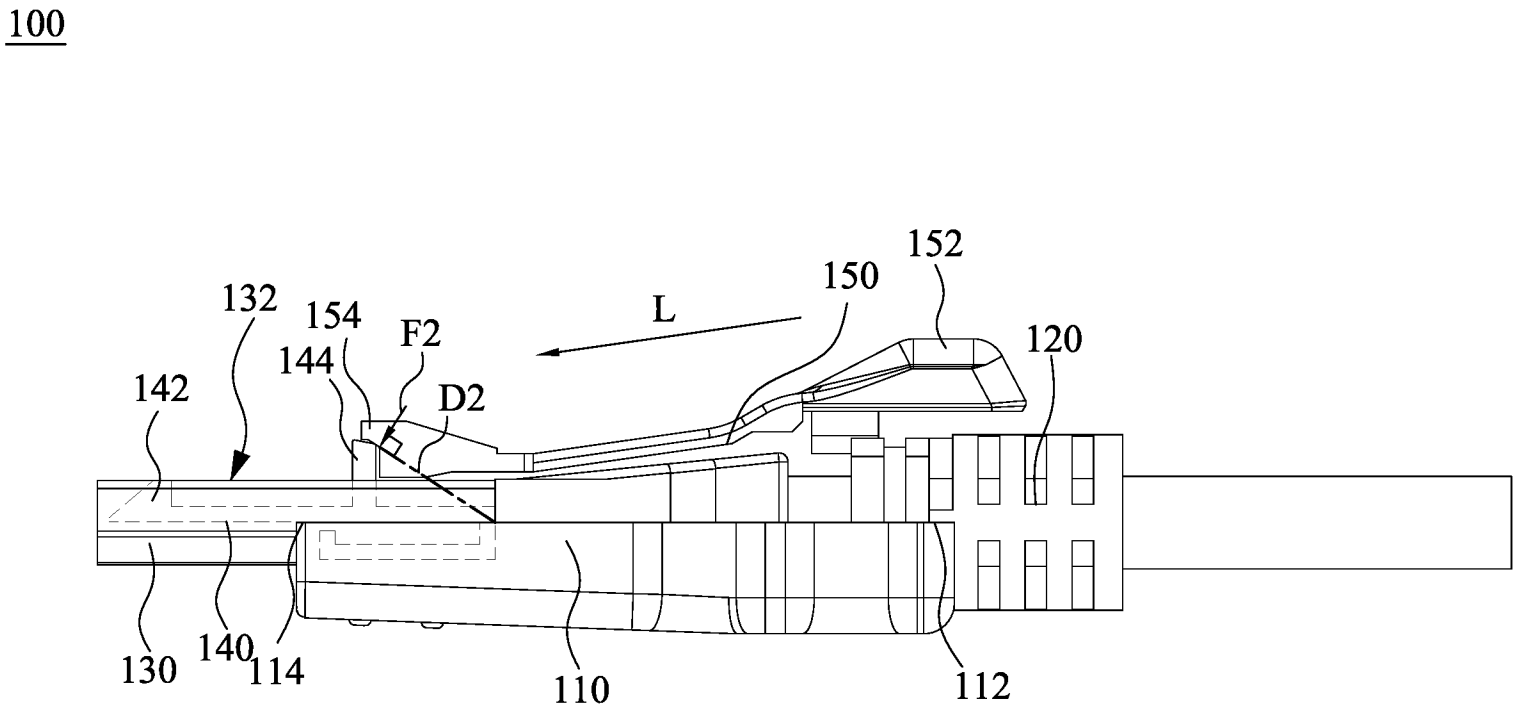

FIG. 3 and FIG. 4 illustrate schematic views when the pressing portion 152 of the electrical connector 100 in FIG. 2 is pressed along the longitudinal direction L of the pressing element 150, in which the upper lid 160 is omitted. Referring to both FIG. 3 and FIG. 4, in one embodiment, the angle 8 between the longitudinal direction L of the pressing element 150 and the electrically connection portion 130 may be in a range from 0 to 45 degrees. In detail, the angle 8 between the longitudinal direction L of the pressing element 150 and the electrically connection portion 130 is in a range from 5 to 30 degrees. When the angle 8 is less than 5 degrees, the pressing portion 152 is likely to interfere with the body portion 110 and the connecting wire 120 when the pressing portion 152 is pressed along the longitudinal direction L of the pressing element 150, thereby increasing friction. When the angle 8 is greater than 30 degrees, the pressing portion 152 is pressed along the longitudinal direction L of the pressing element 150, and the pressing portion 152 is likely to interfere with the upper lid 160, thereby increasing friction as well.

In addition, the driving portion 154 of the pressing element 150 is located higher than a top surface 146 of the abutting end 144 of the locking element 140. The driving portion 154 of the pressing element 150 further includes a concave portion 155. With such a design, a portion (such as a top portion) of the abutting end 144 of the locking element 140 may be located in the concave portion 155 of the driving portion 154, so as to facilitate the driving portion 154 of the pressing element 150 to press down the abutting end 144 of the locking element 140. In one embodiment, the driving portion 154 of the pressing element 150 may also have an inclined surface 154*a*. The inclined surface 154*a* of the driving portion 154 is configured to press the abutting end 144 of the locking element 140.

Referring to FIG. 3, when the pressing portion 152 of the pressing element 150 is pressed by a force F along the longitudinal direction L of the pressing element 150, the force F may be transmitted to the driving portion 154 of the pressing element 150 to generate a force F1. The force F1 has a force arm D1 which is perpendicular to the force F1, and the force F1 may generate a torque for driving the abutting end 144 of the locking element 140. In addition, referring to FIG. 4, the force F may also be transmitted to the abutting end 144 of the locking element 140 to generate a force F2. The force F2 has a force arm D2 which is perpendicular to the force F2, and the force F2 may also generate a torque for driving the abutting end 144 of the locking element 140. By this design, the force F pressed to the pressing portion 152 of the pressing element 150 may generate a total torque (F1×D1+F2×D2). The pressing portion 152 located close to the connecting wire 120 has longer force arms D1 and D2, so the user may press the pressing portion 152 of the pressing element 150 along the longitudinal direction L of the pressing element 150 with less effort. Compared with a traditional design of pressing a locking element in a vertical direction, a combination of the pressing element 150 and the locking element 140 in the present disclosure may save more than 50% of a force for a user.

Figure 5:
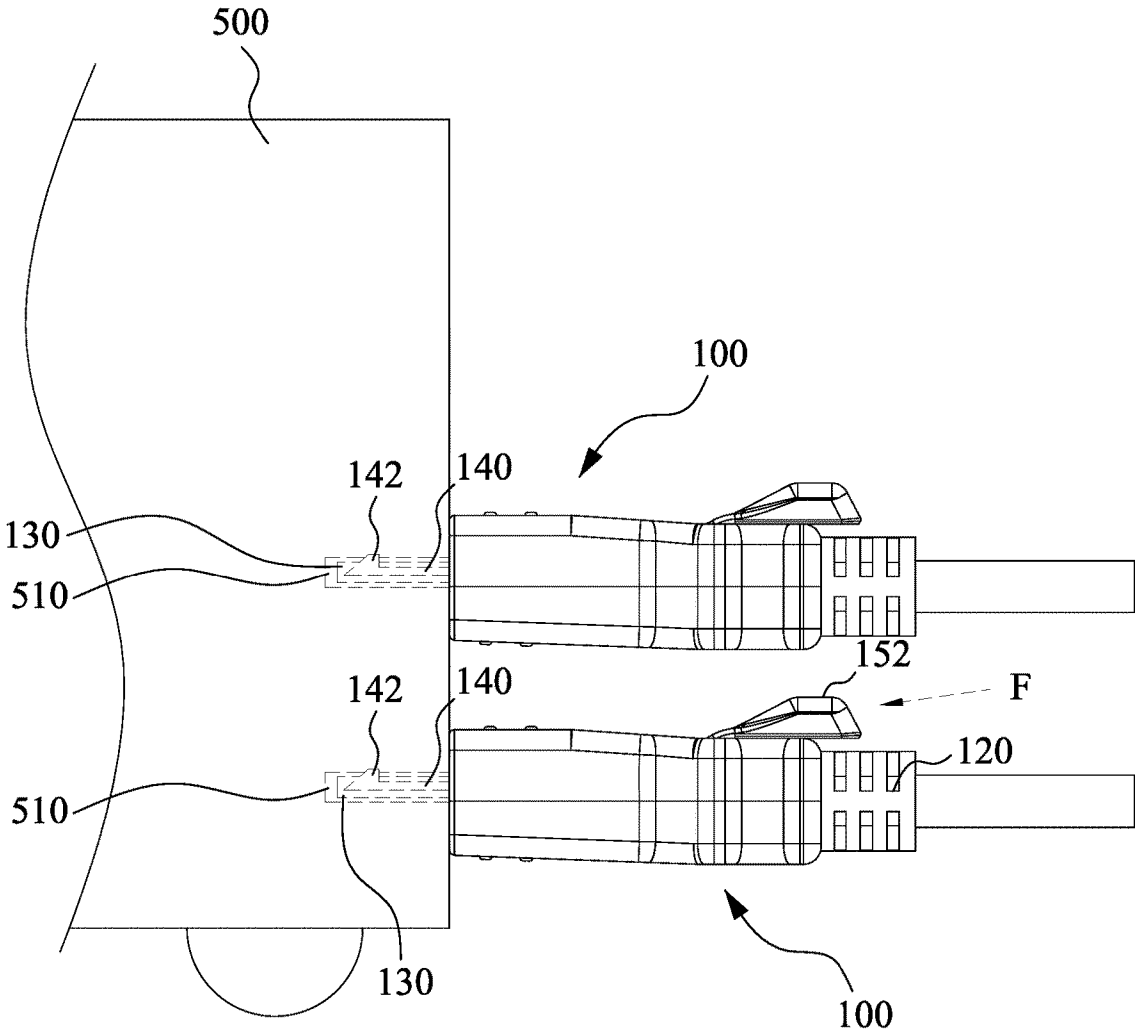
FIG. 5 illustrates a schematic view when using the electrical connector in FIG. 1, in which the electrical connector arranges in an up-and-down way.

FIG. 5 illustrates a schematic view when using the electrical connector 100 in FIG. 1, in which the electrical connector 100 arranges in an up-and-down way. Referring to FIG. 5, the two electrical connectors 100 are arranged up and down, and the electrically connection portions 130 of the electrical connectors 100 are respectively inserted into interfaces 510 of an electronic device 500. The fastening end 142 of the locking element 140 in the electrically connection portion 130 may provide a positioning effect. The electronic device 500 may include video players, displays, recording devices, notebook computers, and desktop computers. In some embodiments, when the lower electrical connector 100 is detached from the interface 510 of the electronic device 500, because the pressing portion 152 of the lower electrical connector 100 is located close to the connecting wire 120, it may avoid the interference of the upper electrical connector 100 to the lower electrical connector 100. In other words, the user may directly remove the lower electrical connector 100, having no need to remove the upper electrical connector 100 at first, thereby saving effort and time, and increasing a convenience of an operation.

It is to be noted that the connection relationship of the aforementioned elements will not be repeated.

Figure 6:
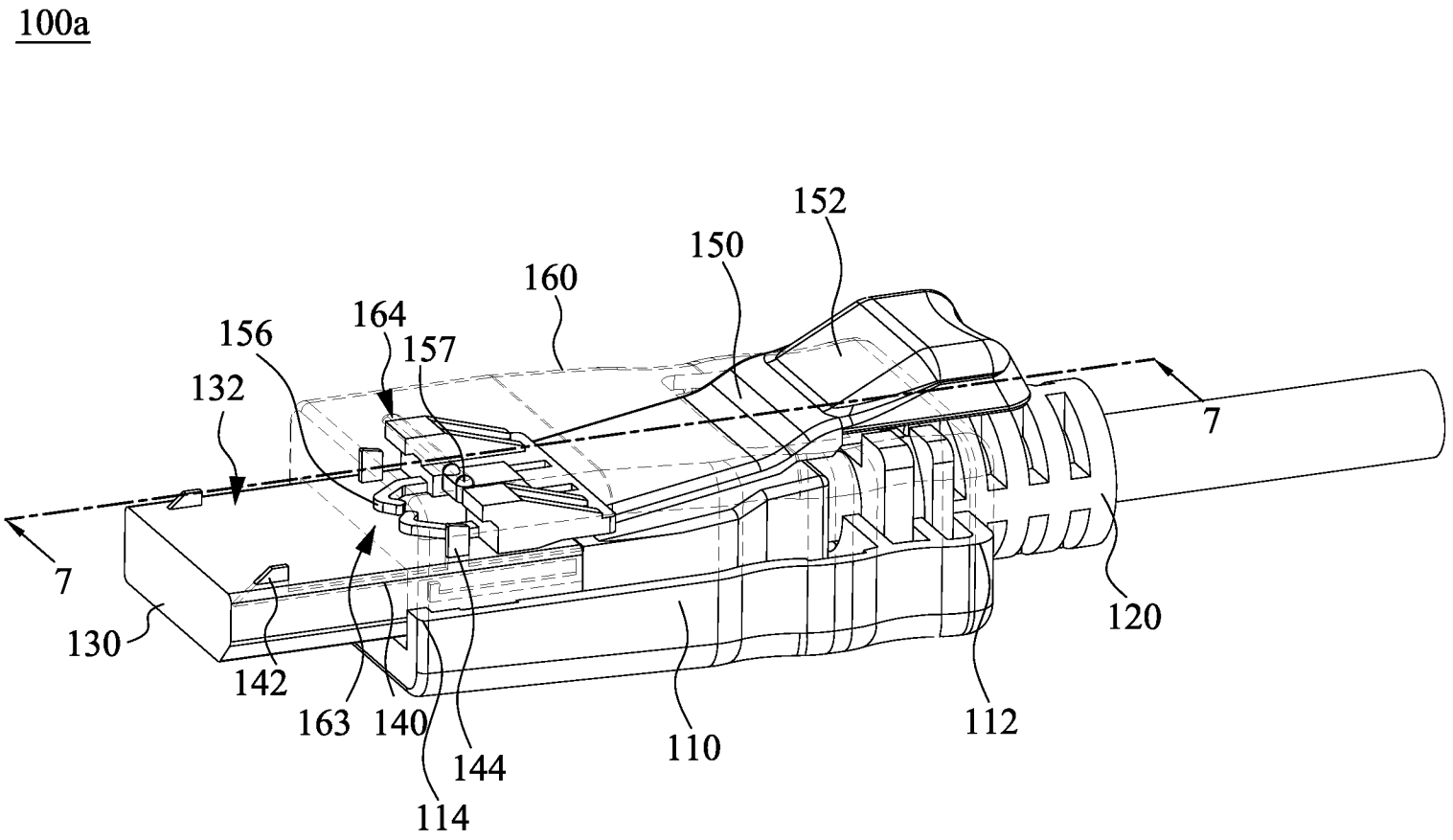
FIG. 6 illustrates a perspective view of an electrical connector according to another embodiment of the present disclosure, in which an upper lid is shown by dotted lines.
Figure 7:
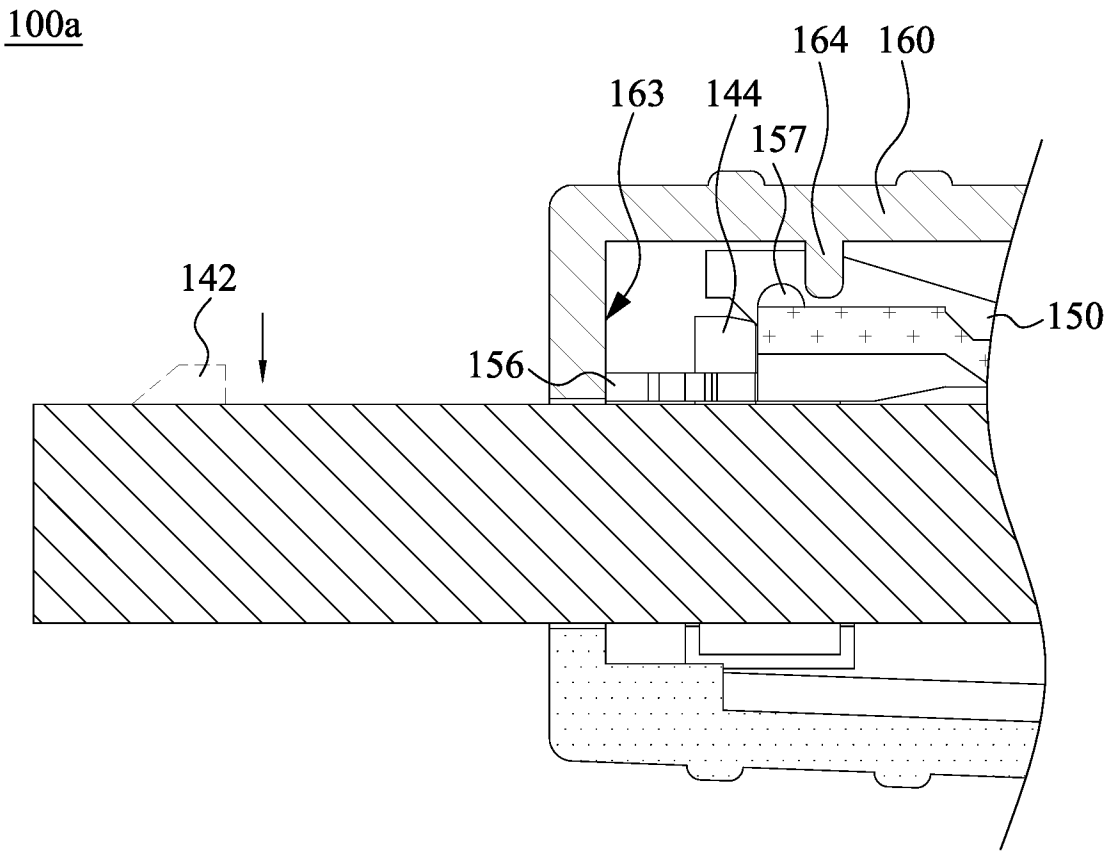
FIG. 7 illustrates a cross-sectional view of the electrical connector in FIG. 6 along a line 7-7.

FIG. 6 illustrates a perspective view of an electrical connector 100*a* according to another embodiment of the present disclosure, in which the upper lid 160 is shown by dotted lines. FIG. 7 illustrates a cross-sectional view of the electrical connector 100*a* in FIG. 6 along a line 7-7, in which the pressing element 150 in FIG. 7 is pressed, and a bump 157 of the pressing element 150 passes through a protruding rib 164 of the upper lid 160. Referring to both FIG. 6 and FIG. 7, the electrical connector 100*a* includes a body portion 110, a connecting wire 120, an electrically connecting portion 130, a locking element 140, and a pressing element 150. The difference from the embodiment in FIG. 1 is that the upper lid 160 of the electrical connector 100*a* includes a first interference structure 164 facing to the pressing element 150, and the pressing element 150 of the electrical connector 100*a* includes a second interference structure 157 facing to the upper lid 160. The second interference structure 157 is configured to abut the first interference structure 164. In one embodiment, the first interference structure 164 is a protruding rib protruding to the pressing element 150, and the second interference structure 157 is a bump protruding to the upper lid 160. The pressing element 150 of the electrical connector 100*a* further includes a pushback element 156. The bump 157 of the pressing element 150 is configured to abut the protruding rib 164 of the upper lid 160 to generate feedback to the pressing element 150. When a force is pressed to the pressing portion 152 of the pressing element 150, the bump 157 of the pressing element 150 may pass through the protruding rib 164 of the upper lid 160 to generate feedback to the users, so the users will know that the driving portion 154 has driven the abutting end 144 of the locking element 140, that is, the fastening end 142 of the locking element 140 has been declined into the electrically connection portion 130, and the electrical connector 100*a* may be detached.

In addition, the pushback element 156 is configured to abut an internal sidewall 163 of the upper lid 160 after the bump 157 of the pressing element 150 passes through the protruding rib 164 of the upper lid 160. As a result, after the electrical connector 100*a* is detached by the users, a force on the pressing portion 152 of the pressing element 150 may be released, and the pushback element 156 may generate a pushback force to reset locations of the pressing element 150 and the locking element 140 simultaneously. The pushback element 156 is located closer to the internal sidewall 163 of the upper lid 160 than the driving portion 154.

Figure 8:
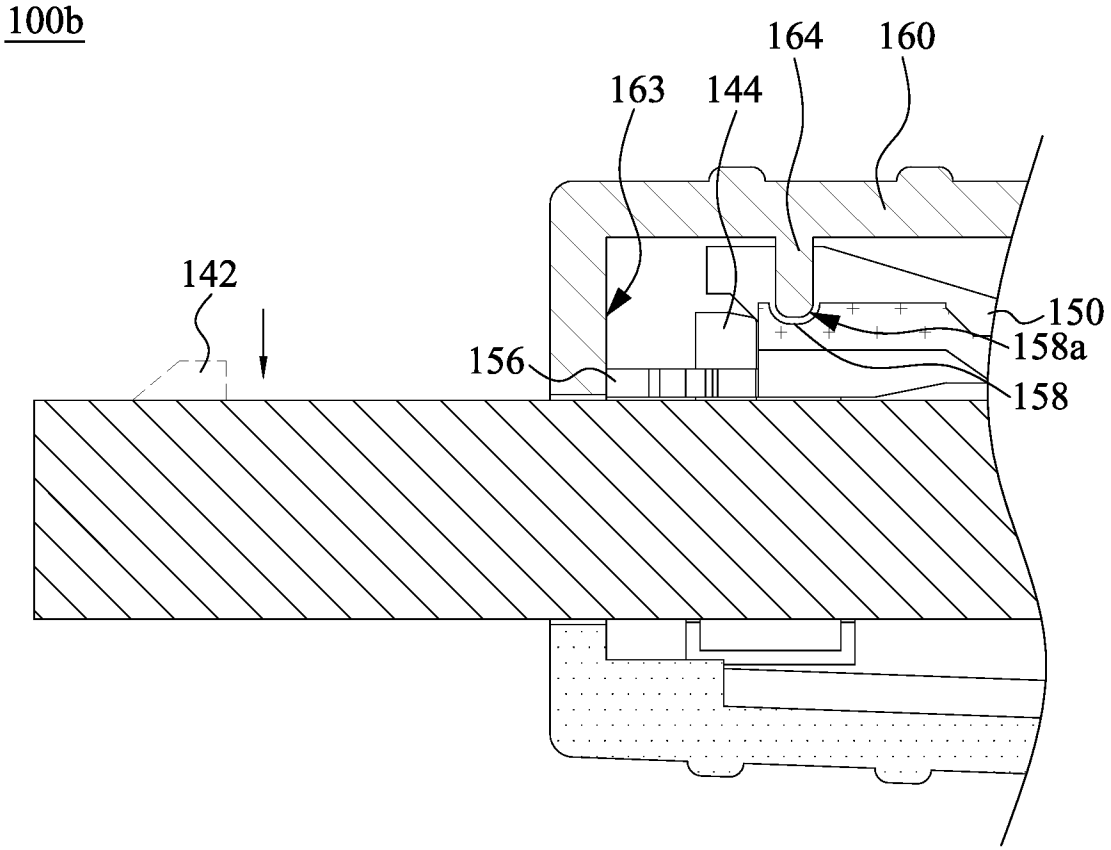
FIG. 8 illustrates a cross-sectional view of an electrical connector according to yet another embodiment of the present disclosure, in which a location of a cross-section is the same as that in FIG. 7.

FIG. 8 illustrates a cross-sectional view of an electrical connector 100*b* according to yet another embodiment of the present disclosure, in which a location of a cross-section is the same as that in FIG. 7. The upper lid 160 of the electrical connector 100*b* includes a first interference structure 164 facing to the pressing element 150. In one embodiment, the first interference structure 164 is a protruding rib protruding to the pressing element 150. The difference from the embodiment in FIG. 7 is that the pressing element 150 of the electrical connector 100*b* includes a second interference structure 158 facing to the upper lid 160, but the pressing element 150 does not include the bump 157 in FIG. 7. In one embodiment, the second interference structure 158 is a trench facing to the upper lid 160. A surface 158*a* of the trench 158 is configured to abut the protruding rib 164 of the upper lid 160 to generate feedback to the pressing element 150. When a force is pressed to the pressing portion 152 of the pressing element 150, the protruding rib 164 of the upper lid 160 may be fastened into the trench 158 of the pressing element 150, which provides feedback to the users, and the users will know that the driving portion 154 has driven the abutting end 144 of the locking element 140, that is, the fastening end 142 of the locking element 140 has been declined into the electrically connection portion 130, and the electrical connector 100*b* may be detached.

Figure 9:
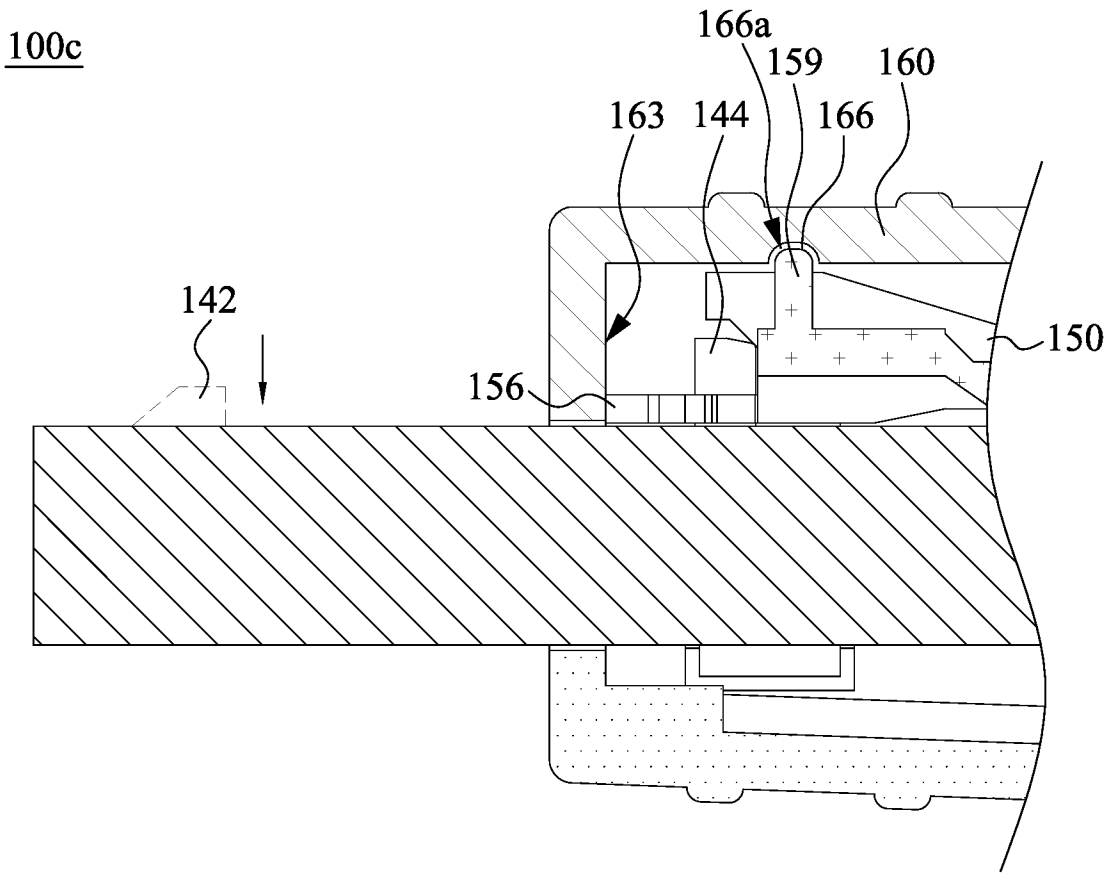
FIG. 9 illustrates a cross-sectional view of an electrical connector according to the other embodiment of the present disclosure, in which a location of a cross-section is the same as that in FIG. 7.

FIG. 9 illustrates a cross-sectional view of an electrical connector 100*c* according to the other embodiment of the present disclosure, in which a location of a cross-section is the same as that in FIG. 7. The difference from the embodiment shown in FIG. 8 is that the upper lid 160 of the electrical connector 100*c* includes a first interference structure 166 facing to the pressing element 150, but the upper lid 160 does not include the protruding rib 164 in FIG. 8, and the pressing element 150 of the electrical connector 100*c* includes a second interference structure 159 facing to the upper lid 160, but the pressing element 150 does not include the trench 158 in FIG. 8, and the second interference structure 159 is configured to abut the first interference structure 166. In one embodiment, the first interference structure 166 is a trench facing to the pressing element 150, and the second interference structure 159 is a bump protruding to the upper lid 160. The bump 159 of the pressing element 150 is configured to abut a surface 166*a* of the trench 166 of the upper lid 160 to generate feedback to the pressing element 150. When a force is pressed to the pressing portion 152 of the pressing element 150, the bump 159 of the pressing element 150 may be fastening into the trench 166 of the upper lid 160 to give feedback to the users, and the users will know that the driving portion 154 has driven the abutting end 144 of the locking element 140, that is, the fastening end 142 of the locking element 140 has been declined into the electrically connection portion 130, and the electrical connector 100*c* may be detached.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An electrical connector, comprising:

a body portion having a first end portion and a second end portion opposite to the first end portion;

a connecting wire located at the first end portion of the body portion;

an electrically connecting portion located at the second end portion of the body portion;

a locking element located at the electrically connecting portion and having an abutting end and a fastening end, wherein the abutting end is located in the body portion, and the fastening end is located outside of the body portion; and a pressing element movably disposed on the body portion, wherein two ends of the pressing element are a pressing portion and a driving portion, respectively, the pressing portion is adjacently configured to the first end portion of the body portion, the driving portion is to contact the abutting end, the pressing portion is aligned with or exceeds the first end portion of the body portion, and when the pressing portion is pressed along a longitudinal direction of the pressing element, the driving portion drives the abutting end, thereby driving the fastening end to move from a locking position to an unlocking position.

2. The electrical connector of claim 1, wherein at least a portion of the pressing portion overlaps the connecting wire in a vertical direction.

3. The electrical connector of claim 1, wherein the driving portion of the pressing element further comprises a concave portion, and a portion of the abutting end is located in the concave portion.

4. The electrical connector of claim 1, wherein the driving portion of the pressing element has an inclined surface, and the inclined surface is configured to suppress the abutting end of the locking element.

5. The electrical connector of claim 1, wherein an angle between the longitudinal direction of the pressing element and the electrically connecting portion is in a range from 0 to 45 degrees.

6. The electrical connector of claim 5, wherein the angle between the longitudinal direction of the pressing element and the electrically connecting portion is in a range from 5 to 30 degrees.

7. The electrical connector of claim 1, further comprising: an upper lid covering the body portion, the driving portion of the pressing element and the abutting end of the locking element, wherein the upper lid comprises a first interference structure facing to the pressing element, the pressing element comprises a second interference structure facing to the upper lid, and the second interference structure is configured to abut the first interference structure.

8. The electrical connector of claim 7, wherein the first interference structure is a protruding rib protruding from the upper lid to the pressing element, the second interference structure is a bump protruding from the pressing element to the upper lid, and the bump is configured to abut the protruding rib.

9. The electrical connector of claim 7, wherein the first interference structure is a protruding rib protruding from the upper lid to the pressing element, the second interference structure is a trench facing to the upper lid, and a surface of the trench is configured to abut the protruding rib.

10. The electrical connector of claim 7, wherein the first interference structure is a trench facing to the pressing element, the second interference structure is a bump protruding from the pressing element to the upper lid, and the bump is configured to abut a surface of the trench.

11. The electrical connector of claim 7, wherein the pressing element further comprises a pushback element, and the pushback element is configured to abut an internal sidewall of the upper lid to provide pushback force.

* * * * *